United States Patent [19]

Shirose

[11] 4,079,717

[45] Mar. 21, 1978

[54] FUEL INJECTION SYSTEM OF INTERNAL COMBUSTION ENGINE

[75] Inventor: Haruya Shirose, Yokohama, Japan

[73] Assignee: Nissan Motor Company, Ltd., Japan

[21] Appl. No.: 698,500

[22] Filed: Jun. 22, 1976

[30] Foreign Application Priority Data

Jun. 23, 1975 Japan ..... 50-77222

[51] Int. Cl.[2] ..... F02M 69/00

[52] U.S. Cl. ..... 123/136; 123/140 MP

[58] Field of Search ..... 123/136, 139 AA, 139 AV, 123/139 AW, 139 AF, 140 MP, 140 MC; 137/115, 199

[56] References Cited

U.S. PATENT DOCUMENTS

| | | | |
|---|---|---|---|
| 2,323,525 | 7/1943 | Ebel et al. | 123/139 AA |
| 2,638,912 | 5/1953 | Lee | 123/139 AW |
| 2,684,684 | 7/1954 | Stevenson | 137/199 |
| 2,843,096 | 7/1958 | Dolza et al. | 123/139 AW |
| 3,789,819 | 2/1974 | Moulds | 123/139 AW X |

FOREIGN PATENT DOCUMENTS

| | | | |
|---|---|---|---|
| 2,351,202 | 4/1975 | Germany | 137/115 |
| 995,919 | 6/1965 | United Kingdom | 137/199 |

*Primary Examiner*—Charles J. Myhre
*Assistant Examiner*—Tony M. Argenbright

[57] ABSTRACT

A device functions to vent only gases trapped in a pressure line connecting a fuel pump and fuel injectors to rapidly deliver liquid fuel from the fuel pump through the pressure line to the fuel injectors.

9 Claims, 3 Drawing Figures

FUEL INJECTION SYSTEM OF INTERNAL COMBUSTION ENGINE

This invention relates generally to a fuel injection system of an internal combustion engine and more particularly to a device for venting gases trapped in a fuel line upstream of the fuel injectors of the engine.

In connection with an internal combustion engine equipped with a fuel injection system of the type wherein liquid fuel stored in a fuel tank is fed to and pressurized by a fuel pump and delivered through a pressure line to fuel injectors for injecting atomized liquid fuel into a portion of the engine, the pressure line connecting the fuel pump and the fuel injectors inevitably and unavoidably contains trapped air when the engine is newly assembled and taken out of the assembly line, or when fuel in the fuel tank of the engine is completely consumed to empty the fuel tank and the engine is started again after a new supply of fuel. The air trapped in the pressure line is usually injected through the fuel injectors into a portion of the engine such as the intake manifold or combustion chambers. However, this type of engine has encountered difficulties in which combustion of the charge in the combustion chambers is not started until all the air trapped in the pressure line is discharged through the fuel injectors and therefore a considerably long time of cranking or the engine crankshaft rotation by a starting motor is necessary. This leads to difficulty in starting the engine.

It is, therefore, a principal object of the present invention to provide an improved fuel injection system for an internal combustion engine capable of allowing the engine to start easily even if a pressure line connecting the fuel pump and fuel injectors is filled with air.

Another object of the present invention is to provide an improved fuel injection system of an internal combustion engine, which system is equipped with a device reducing the cranking time of the engine.

A further object of the present invention is to provide an improved fuel injection system of an internal combustion engine, which system is equipped with a device for venting gases trapped in a pressure line connecting the fuel pump and fuel injectors and causing liquid fuel from the fuel pump to reach the fuel injectors within a short period of time.

Other objects and features of the improved fuel injection system in accordance with the present invention will become more apparent from the following description taken in conjunction with the accompanying drawings, in which.

Figure 1:
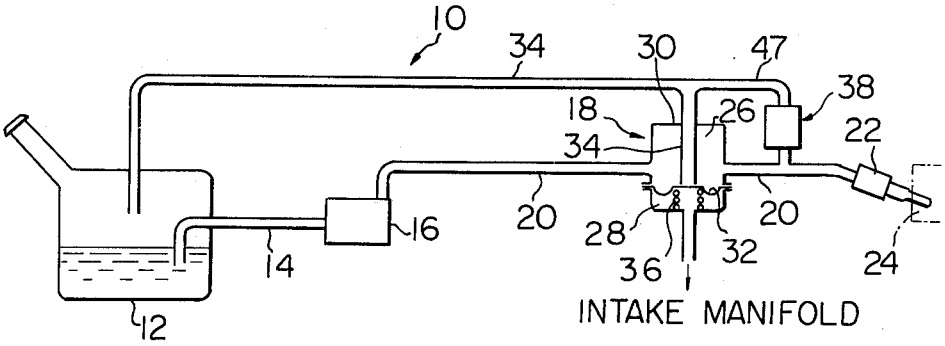
FIG. 1 is a sketch of a preferred embodiment of a fuel injection system according to the present invention.

Referring now to FIG. 1, there is shown a preferred embodiment of a fuel injection system of an internal combustion engine, which is generally designated by the reference numeral 10. The fuel injection system 10 comprises a fuel tank 12 for storing a liquid fuel therein. The fuel tank 12 communicates through a pipe 14 with a fuel pump 16 which sucks the liquid fuel from the fuel tank 12 through the pipe 14 and pressurizes it. The fuel pump 16 is connected through a fuel pressure regulator 18 with a fuel injector 22 or injectors which are disposed at a portion of the engine (not shown), such as at an intake manifold 24 or an intake passage in order to inject the atomized liquid fuel thereinto. The fuel injectors may be disposed at the combustion chambers (not shown) of the engine to directly inject the fuel thereinto.

The fuel pressure regulator 18 functions to maintain the pressure drop across the fuel injector 24 at a predetermined level such as 2.55 kg/cm$^2$ regardless of changes in the pressure within the intake manifold 24. With this regulator 18, the fuel amount supplied to the engine can be controlled only by the opening time of the fuel injector 22. The fuel pressure regulator 18 comprises a fuel chamber 26 and a vacuum chamber 28 which are defined in casing 30 by a diaphragm 32. Disposed in the fuel chamber 26 and opening adjacent to the diaphragm 32 is one end of a fuel return line 34 the other end of which opens to an upper portion of the fuel tank 12. As shown, a spring 36 is disposed within the vacuum chamber 28 to normally urge the diaphragm 32 in the direction to close the opening of the one end of the fuel return line 34. The spring is compressed to allow the diaphragm 32 to open the one end of the fuel return line 34 in response to the vacuum transmitted to the vacuum chamber 28 from the intake manifold 24. It will be understood that when the fuel is directly injected into the combustion chambers, such a pressure regulator is not necessary.

The reference numeral 38 indicates a gas vent device or gas vent means which allows gases from the pressure line 20 to pass therethrough and flow to the return line 34, and blocks the liquid fuel from the pressure line 20 to pass therethrough. The gases consist of almost all air and a small part of vapourized fuel.

Figure 2:
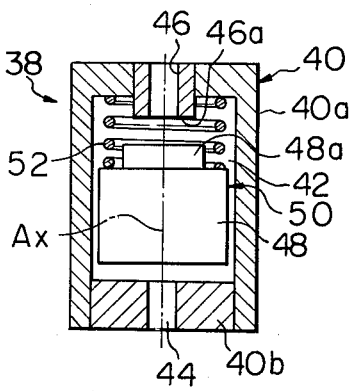
FIG. 2 is a sectional view of an example of a gas vent device of the fuel injection system of FIG. 1.

FIG. 2 illustrates in detail an example of the gas vent device 38. As seen, the gas vent device 38 comprises a casing 40 defining therein a cylindrical chamber 42. The casing 40 comprises, as shown, a cup-shaped member **40*a* and a bottom member 40*b* which closes the bottom opening of the cup-shaped member 40*a*. The axis Ax of the chamber 42 is substantially perpendicular to a portion of the pressure line 20 which is substantially horizontal or substantially parallel to the ground (not shown). The cylindrical chamber 42 has an inlet 44 formed through the bottom member 40*b* defining the lower end of the chamber 42 and an outlet 46 formed through the top portion of the cup-shaped member 40*a* defining the upper end of the chamber 42. The inlet 44 communicates with a portion of the pressure line 20 between the fuel pressure regulator 18 and the fuel injector 22, whereas the outlet 46 communicates through a pipe 47 with the return line 34. The outlet 46 is formed with a valve seat 46*a*. A cylindrical float 48 forming part of valve means 50 is disposed within the chamber 42 and spaced apart from the cylindrical inner surface of the chamber 42 to be movable along the axis Ax of the chamber 42. The cylindrical float 48 has a valve member 48*a* which is secured to the upper surface portion thereof facing the outlet 46, the valve member 48*a* being sealingly contactable with the valve seat 46*a*. As shown, a spring 52 is disposed between the upper end of the chamber 42 and the upper surface of the cylindrical float 48 to normally urge the cylindrical float 48 in the direction to close the inlet 44. It is to be noted that the diameter of the chamber 42, the outer diameter of the float 48, the spring constant of the spring 52 and other factors of the device 38 are selected to allow the float 48 to move to open both the inlet 44 and the outlet 46 of the chamber 42 when the gases from the pressure line 20 are admitted into the chamber 42, and allow the float 48 to move to open the inlet 44 and close the outlet 46 when only liquid fuel from the pressure line 20 is admitted into the chamber 42. This manner of operation of the float 48 depends upon the pressure differential between the upstream and downstream sides of the float 48**. The pressure differential P is given by the following equation:

$$P = \left(\frac{Q}{\alpha A}\right)^2 \cdot \frac{\gamma}{2g}$$

where,

Q = flow rate ($m^3/s$), $\alpha$ = flow coefficient,

A = cross-sectional area between the chamber 42 and the float 48, $\gamma$ = specific weight, liquid fuel (gasoline or petrol): about $740 kg/m^3$, gases(air): $1.2 kg/m^3$ (at 1 atm. and at room temp.).

From the above equation, it will be apparent that the pressure differential P in case of gasoline is several times that of air. The gas vent device 38 is designed depending upon this fact.

With the arrangement of the gas vent device 38 hereinbefore described, when the engine is started with the fuel pump 16 operation, air in the pressure line is pushed by the liquid fuel pressurized by the pump and flows through the pressure line 20 to the fuel injector 22 and also to the gas vent device 38, the air introduced through the inlet 44 into the cylindrical chamber 42 of the gas vent device 38, the pressure differential is produced between the upstream and downstream sides of the float 48. However, since the pressure difference is relatively small in this case, the effect of compression of the spring 52 is relatively small and accordingly the inlet 44 and the outlet 46 are both kept open to allow the air to pass through the gas vent device 38. The passed air then flows through the pipe 47 into the return line 34. The air introduced into the return line 34 is discharged through the fuel tank 12 to the atmosphere.

When the air is removed from the pressure line 20, the liquid fuel in the pressure line 20 is admitted through the inlet 44 into the chamber 42 of the gas vent device 38. Then, the liquid fuel flowing into the chamber 42 produces a relatively large pressure differential between the upstream and downstream sides of the float 48 to compress the spring 52 such that the valve member **48*a* of the float 48 contacts the valve seat 46*a* of the outlet 46. Accordingly, communication between the inlet 44 and the outlet 46 is blocked to stop the fuel flow through the gas vent device 38**.

Figure 3:
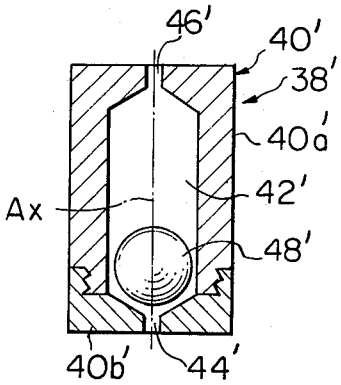
FIG. 3 is a sectional view of another example of the gas vent device of FIG. 2.

FIG. 3 illustrates another example of a gas vent device 38' which comprises a casing 40' defining therein a cylindrical chamber 42'. The casing 40' is constructed by a cup-shaped member **40*a*' and a bottom member 40*b*' screwed to the bottom portion of the cup-shaped member 40*a*' closing the bottom opening of the member 40*a*'. The axis Ax of the chamber 42' is substantially perpendicular to the portion of the pressure line 20 which is substantially horizontal or substantially parallel to the ground. The cylindrical chamber 42' has an inlet 44' formed through the bottom member 40*b*' defining the lower end of the chamber 42' and an outlet 46' formed through the closed top portion of the cup-shaped member 40*a*' defining the upper end of the chamber 42'. The inlet 44' communicates with the portion of the pressure line 20 between the fuel pressure regulator 18 and the fuel injector 22, whereas the outlet 46' communicates through the pipe 47 with the return line 34. As shown, the cylindrical chamber 42' is formed with an upper conical recess (no numeral) at its upper portion and a lower recess (no numeral) at its lower portion, the outlet 46' and the inlet 44' being respectively formed at the central portions of the upper and lower recesses. It is to be noted that the inlet 44' and outlet 46' of the cylindrical chamber 42' are coaxial along the axis Ax. Disposed within the cylindrical chamber 42' and spaced apart from the cylindrical wall of the chamber 42' is a sphercial float 48' or valve means which is normally urged by gravity in the direction to close the inlet 44' of the cylindrical chamber 42'. In this case, the material and the size of the spherical float 48' are selected to cause the float 48' to keep open both the inlet 44' and the outlet 46' when air flows through the chamber 42', and to cause the float 48' to keep open the inlet 44' and close the outlet 46' when only liquid fuel fills the chamber 42'**.

With this gas vent device 38', when air is admitted into the chamber 42' of the device 38', the float 48' is moved upwardly by the pressure depending upon the stream of the air. However, the pressure is relatively small and therefore the float is maintained adjacent the lower conical recess of the chamber 42'. Accordingly, the inlet 44' and the outlet 46' are kept open to allow the air to flow through the device 38'. The air is thereafter introduced the pipe 47 and the return line 34 into the fuel tank 12. The air introduced to the fuel tank 12 is finally discharged to the atmosphere.

When the air is discharged from the pressure line 20 and the liquid fuel is admitted into the chamber 42', the float 48' is urged to close the outlet 46' to stop the liquid fuel to leak therethrough.

It will be appreciated from the foregoing discussion that according to the present invention, liquid fuel pressurized by the fuel pump is delivered smoothly and rapidly through the pressure line to the injectors within a short period of time during engine cranking, even if the pressure line is filled with air or other gases particularly when the engine is newly assembled and taken out of the assembly line or when fuel in the fuel tank is completely consumed to empty the fuel tank and the engine is started again after a new supply of fuel. This contributes to shortening the time required for cranking of the engine and accordingly to improvement in starting of the engine.

What is claimed is:

1. In a fuel injection system of an internal combustion engine, including a fuel tank for storing liquid fuel therein;

a fuel pump communicating with said fuel tank for pressurizing the liquid fuel received from said fuel tank;

a fuel injector for injecting the fuel delivered from said fuel pump into a portion of the engine;

a pressure line connecting said fuel pump and said fuel injector, said pressure line having a substantially horizontal portion; the improvement comprising gas vent means for allowing gases admitted thereinto from said pressure line to discharge out of the pressure line and blocking the liquid fuel admitted thereinto from said pressure line to discharge out of the pressure line, said gas vent means including a casing defining therein a cylindrical chamber, the axis of the cylindrical chamber being substantially perpendicular to said substantially horizontal portion of said pressure line, said cylindrical chamber having at its lower end an inlet which communicates with a portion of said pressure line, and at its upper end an outlet which communicates with the atmosphere, and valve means for opening both the inlet and outlet of said cylindrical chamber to establish communication therebetween when gases from said pressure line are admitted into said cylindrical chamber, and opening the inlet and closing the outlet to block the communication therebetween when only liquid fuel from said pressure line is admitted into said cylindrical chamber, said valve means being disposed within said cylindrical chamber; and a fuel pressure regulator for maintaining a pressure drop across said fuel injector at a predetermined level regardless of change in the pressure within said portion of the engine to which said fuel injector injects the fuel, said fuel pressure regulator including a casing forming therein a space, a diaphragm separating the space into a fuel chamber disposed in said fuel line upstream of the portion of said pressure line with which portion the inlet of the cylindrical chamber of said gas vent means communicates, the pressurized fuel from the fuel pump being forced through said fuel chamber to said fuel injector, and a vacuum chamber communicating with said portion of the engine, a fuel return line connecting said fuel chamber and said fuel tank, one end of said return line being opened adjacent said diaphragm and another end of the same being opened within the fuel tank, and a spring disposed within said vacuum chamber for normally urging said diaphragm in the direction to close the opening of the one end of said fuel return line, said spring being selected to be compressed to allow said diaphragm to open the one end of said fuel return line in response to the vacuum transmitted to said vacuum chamber from said portion of the engine.

2. A fuel injection system as claimed in claim 1, in which said valve means includes:

a float disposed in said cylindrical chamber and spaced apart from the inner wall of said cylindrical chamber to be movable along the axis of said cylindrical chamber; and a spring disposed in the cylindrical chamber for normally urging said float in the direction to close the inlet of said cylindrical chamber;

said float and spring being selected to allow said float to move to open both the inlet and the outlet of said cylindrical chamber when gases from said pressure line are admitted into the cylindrical chamber, and to allow said float to move to open the inlet and close the outlet when only liquid fuel from said pressure line fills said cylindrical chamber.

3. A fuel injection system as claimed in claim 2, in which said float has a valve member which is secured to the surface portion thereof facing the outlet of said cylindrical chamber.

4. A fuel injection system as claimed in claim 3, in which said outlet is formed with a valve seat which is sealingly contactable with said valve member.

5. A fuel injection system as claimed in claim 1, in which said cylindrical chamber is formed with an upper conical recess at its upper portion and a lower conical recess at its lower portion, the outlet and the inlet being respectively formed at the central portions of the upper and lower conical recesses.

6. A fuel injection system as claimed in claim 5, in which said valve means is a spherical float disposed within said cylindrical chamber to move along the axis thereof, said spherical float being normally urged by gravity in the direction to close the inlet of the cylindrical chamber, said spherical float being selected to be allowed to move such that both the inlet and the outlet of said cylindrical chamber are opened when gases from said pressure line are admited into the cylindrical chamber, and the inlet is opened and the outlet is closed when only liquid fuel from said pressure line fills said cylindrical chamber.

7. A fuel injection system as claimed in claim 1, further comprising an air intake passage communicable with the combustion chamber of the engine, said fuel injector being disposed within said air intake passage.

8. In a fuel injection system of an internal combustion engine, comprising:

a fuel tank for storing liquid fuel therein;

a fuel pump communicating with said fuel tank for pressurizing the liquid fuel received from said fuel tank;

a fuel injector for injecting the fuel delivered from said fuel pump into a portion of the engine;

a pressure line connecting said fuel pump and said fuel injector, said pressure line having a substantially horizontal portion, the improvement comprising gas vent means for allowing gases admitted thereinto from said pressure line to discharge out of the pressure line and blocking the liquid fuel admitted thereinto from said pressure line to discharge out of the pressure line, said gas vent means including a casing defining therein a cylindrical chamber, the axis of the cylindrical chamber being substantially perpendicular to said substantially horizontal portion of said pressure line, said cylindrical chamber having at its lower end an inlet which communicates with a portion of said pressure line, and at its upper end an outlet which communicates with the atmosphere, and valve means disposed within said cylindrical chamber and including a float disposed in said cylindrical chamber and spaced apart from the inner wall of said cylindrical chamber to be movable along the axis of said cylindrcal chamber, and a spring disposed in the cylindrical chamber for normally urging said flot in the direction to close the inlet of said cylindrical chamber, said float and spring being selected to allow said float to move to open both the inlet and the outlet of said cylindrical chamber when gases from said pressure line are admitted into the cylindrical chamber, and to allow said float to move to open the inlet and close the outlet when only liquid fuel from said pressure line fills said cylindrical chamber; and a fuel pressure regulator for maintaining a pressure drop across said fuel injector at a predetermined level regardless of change in the pressure within said portion of the engine to which said fuel injector injects the fuel, said fuel pressure regulator including a casing forming therein a space, a diaphragm separating the space into a vacuum chamber communicating with said portion of the engine, and a fuel chamber disposed in said fuel line upstream of its portion with which the inlet of the cylindrical chamber of said gas vent means communicates, the pressurized fuel from the fuel pump being forced through said fuel chamber into said fuel injector, said fuel chamber having a larger volume than said vacuum chamber to absorb the pulsation of the fuel pressure generated in said pressure line by the operation of said injector, a fuel return line connecting said fuel chamber and said fuel tank, one end of said return line being opened adjacent said diaphragm and another end of the same being opened within the fuel tank, and a spring disposed within said vacuum chamber for normally urging said diaphragm in the direction to close the opening of the one end of said fuel return line, said spring being selected to be compressed to allow said diaphragm to open the one end of said fuel return line in response to the vacuum transmitted to said vacuum chamber from said portion of the engine.

9. A fuel injection system as claimed in claim 8, in which said pressure regulator is so disposed that the longitudinal axis thereof is perpendicular to the axis of the substantially horizontal portion of said pressure line, said vacuum chamber being formed under said fuel chamber through said diaphragm.

* * * * *